US006594934B1

(12) United States Patent
Wong

(10) Patent No.: US 6,594,934 B1
(45) Date of Patent: Jul. 22, 2003

(54) DISPLAY APPARATUS

(76) Inventor: Wing Hang Wong, Flat B, 23/F, Way Lee Ind. Centre, 38 Tsuen King Circuit, Tsuen Wan (HK)

( * ) Notice: Subject to any disclaimer, the term of this patent is extended or adjusted under 35 U.S.C. 154(b) by 0 days.

(21) Appl. No.: 09/408,801

(22) Filed: Sep. 30, 1999

(30) Foreign Application Priority Data

Jan. 25, 1999 (CN) ..... 99235241 U

(51) Int. Cl.[7] ..... A47G 1/06
(52) U.S. Cl. ..... 40/743; 40/771; 40/738
(58) Field of Search ..... 40/743, 738, 771, 40/772, 776, 124.07

(56) References Cited

U.S. PATENT DOCUMENTS

| | | | | | |
|---|---|---|---|---|---|
| 2,565,553 | A | * | 4/1951 | Foley | 428/12 |
| 2,968,108 | A | * | 1/1961 | Knox | 40/743 |
| 3,041,762 | A | * | 7/1962 | Knox | 40/738 |
| 3,237,332 | A | * | 3/1966 | Petrey | 40/738 |
| 3,333,358 | A | * | 8/1967 | Green et al. | 40/738 |
| 3,596,391 | A | * | 8/1971 | Knight, Jr. | 40/720 |
| 3,715,823 | A | * | 2/1973 | Brossard | 40/743 |
| 3,952,437 | A | | 4/1976 | Mitchell | |
| 3,987,995 | A | | 10/1976 | Hamasaki | |
| 4,268,984 | A | | 5/1981 | Taylor | |
| 5,265,357 | A | * | 11/1993 | Yu | 40/714 |
| 5,617,663 | A | * | 4/1997 | Miki et al. | 40/738 |

FOREIGN PATENT DOCUMENTS

| | | |
|---|---|---|
| DK | 297 03 342 U1 | 11/1997 |
| GB | 1 404 801 | 9/1975 |
| GB | 1 513 625 | 6/1978 |
| JP | 9-103349 | 4/1997 |
| JP | 10-243855 | 9/1998 |
| JP | 10-243857 | 9/1998 |
| JP | 10-243858 | 9/1998 |
| JP | 10-243859 | 9/1998 |
| JP | 10-243860 | 9/1998 |

* cited by examiner

*Primary Examiner*—William L. Miller
(74) *Attorney, Agent, or Firm*—Renner, Kenner, Greive, Bobak, Taylor & Weber

(57) ABSTRACT

A display apparatus is suitable for displaying a photograph (4) in such a way as to confer a 3-D effect. The apparatus optionally using a transparent carrier (7) locates the photographs (4) as a concavely curved image using edgewise compressing channels (5). The 3-D effect is enhanced by the convex framing (2) of the photograph (4).

5 Claims, 7 Drawing Sheets

DISPLAY APPARATUS

TECHNICAL FIELD

The present invention relates to display apparatus, assemblies and related apparatus useful for displaying photographs.

BACKGROUND ART

Mounts or frames for photographs are well known. The present invention, however, is directed to the display of photographs or other flexible sheet-substrated images (whether produced by a photographic process or not) in such a way as to confer a three-dimensional effect to a viewer viewing the image from a viewing direction.

The curving of photographs so as to provide a three-dimensional (3-D) viewing effect is known. Some picture frames to provide a 3-D viewing effect rely on a presentation of a convex image bearing surface. In this respect, see, for example, Japanese Patent Specifications JP10243860, JP10243859, JP10243855 and JP9103349. The concave presentation of the photographic image is also known. See DE29703342 where an image is presented in an arcuate form. However, the curvature of the image in that invention is unlikely to achieve a:3-D effect. It appears to be for aesthetic purposes only.

The present invention provides an alternative to such known three-dimensional displays or at least to provide the public with a useful choice.

DISCLOSURE OF THE INVENTION

A first aspect the present invention consists of a display apparatus for conferring a three-dimensional viewing effect to a displayed two-dimensional material, the apparatus including convex surface defining means having a viewing opening therethrough, and material presenting means to present the two-dimensional material for viewing through the opening from the convex surfaced side of the convex surface defining means, wherein the material presenting means can present the two-dimensional material for the viewing when curved oppositely to the convex surface so as to be concavely presented for viewing.

Preferably, the convex surface defining means and at least part of the material presenting means is in a fixed relationship.

Preferably, the two-dimensional material is or is to be a picture or image on a substrate of a flexible sheet material.

Preferably, resilient sandwiching means is provided for the flexible substrate, which resilient sandwiching means are held under edgeways compression in a stable condition by the at least part of the material presenting means so as to provide the concave presentation for viewing of the picture or image.

Preferably, a molded member defines both the convex surface of the convex surface defining means, and behind the convex surface two opposed channels into which the two-dimensional material is to be held under edgewise compression of (a) the two-dimensional material, if resilient or (b) at least one resilient carrier of the two-dimensional material.

Preferably the concave presentation for viewing of the two-dimensional material is in an arc not curved substantially tighter than the circumference of a circle where the axis is that of the concavity.

Preferably the convex surface defining means is not curved substantially tighter than that of the circumference of a circle where the axis is that of the convexity. The arc(s) is or are both about a substantially upright axis.

Preferably, the two-dimensional material without removal from the apparatus can be pushed to a stable curve no longer opposite to the convex surface.

In another aspect, the invention includes a display apparatus for displaying a two-dimensional material, the apparatus having means defining opposed channels in a mutually fixed relationship between which the two-dimensional material can be placed for viewing from a direction ("the viewing direction"), the channels being such that resilient means provided by one of: (i) the two-dimensional material, if of appropriate size and of a resilient sheet form, and (ii) at least one resilient sheet carrier of appropriate size for and lying against the two-dimensional material, can, by virtue of edgewise compression, be held in the channels to provide a concave presentation of the two-dimensional material from the viewing direction which is stable owing at least in part to the appropriate size being greater than the spacing between the channels.

In accordance with another aspect of the invention, a display apparatus for displaying a flexible, sheet-substrated image, including means defining opposed channels in a mutually fixed relationship between which a flexible, sheet-substrated image can be placed for image viewing of its front surface from a direction ("the viewing direction"), the channels being such that resilient means provided by one of: (i) the flexible, sheet-substrated image, if of appropriate size and resilient, and (ii) at least one resilient sheet carrier of appropriate size for and lying against the sheet substrated image, can, by virtue of edgewise compression, be held in the channels to provide a concave presentation of the image from the viewing direction which is stable owing at least in part to the appropriate size being greater than the spacing between the channels.

As used herein, reference to "opposed channels" refers to any molded, fabricated or otherwise provided structure having a continuous, skeletal or other channel-like or the equivalent form (even a simple groove) which opens towards the opposing "channel."

Preferably, the means defining such opposed channels has at least one internal surface to conform with the convex back surface of the resilient means when the front surface of the sheet substrated image is to be or is presented to the viewing direction in a concave manner. Preferably, the means defining the opposed channels also has internal surfaces or an internal surface to conform to the front of the resilient means when it is to be or is presented to the viewing direction in a convex manner. Preferably, the means defining opposed channels is a molded component to provide, with a perimeter for the image, a viewing opening.

In accordance with another aspect of the invention, an assembly includes a display apparatus for displaying a flexible, sheet-substrated image, the apparatus having means defining opposed channels in a mutually fixed relationship between which the flexible, sheet-substrated image can be placed for image viewing of its front surface from a direction ("the viewing direction"), and a resilient sheet substrated image capable of being held in the display apparatus by the opposed channels to provide a stable concave presentation of the image from the viewing direction.

Preferably, the resilient sheet substrated image can be held by the opposed channels under edgewise compression.

In accordance with yet another aspect the invention, an assembly display apparatus for displaying a flexible, sheet-substrated image, the apparatus having means defining opposed channels in a mutually fixed relationship between which a the flexible, sheet-substrated image can be placed for image viewing of its front surface from a direction ("the viewing direction"), and an assemblage of a flexible, sheet-substrated image and at least one resilient sheet, the assemblage being capable of being held in the display apparatus by the opposed channels to provide a stable concave presentation of the image from the viewing direction. Preferably, the assemblage can be held by the opposed channels under edgewise compression.

In yet another aspect of the invention, a display apparatus for displaying a photograph or other flexible, sheet-substrated image (hereafter "photograph") includes a first resilient sheet, a second resilient sheet (whether edgewise connected to the first resilient sheet or not), at least one of the sheets being at least in part transparent, and a mount to accommodate and support the first and second sheets when, in use, as an assemblage with a photograph of appropriate dimensions, they sandwich the photograph for display, wherein the mount is capable of receiving the assemblage and to accommodate the same in a format that displays the photograph through the at least in part transparent sheet for view from a viewing direction, and wherein the assemblage, in use, is held in the mount with edgewise compression of the sheets in a stable concave form (when considered from the viewing direction).

Preferably, without removal from the mount in use, can also, by said edgewise compression, support the assemblage in a stable convex form (when considered from the viewing direction). In addition, preferably without removal from the mount, the assemblage can be pressed from one condition to the other (i.e., stable concave form to stable convex form and vice versa).

Preferably, the mount is provided with molded internal surfaces at least in part, to accord to the curvature of the stablely supported forms of the assemblage, and is also provided with molded external surfaces at least in part to accord to a similar or opposite curvature of the stablely supported forms of the assemblage.

In another aspect of the invention, an apparatus for displaying a photograph or other flexible, sheet-substrated image (hereafter "photograph") includes a resilient photograph, and a mount to accommodate and support the resilient photograph by providing with opposed channels an edgewise compression of the photograph which allows the photograph to favor a stable concave display of the photograph from a viewing direction.

BRIEF DESCRIPTION OF THE DRAWINGS

A preferred form of the present invention will now be described with reference to the accompanying drawings in which.

PREFERRED EMBODIMENTS FOR CARRYING OUT THE INVENTION

Figure 1:
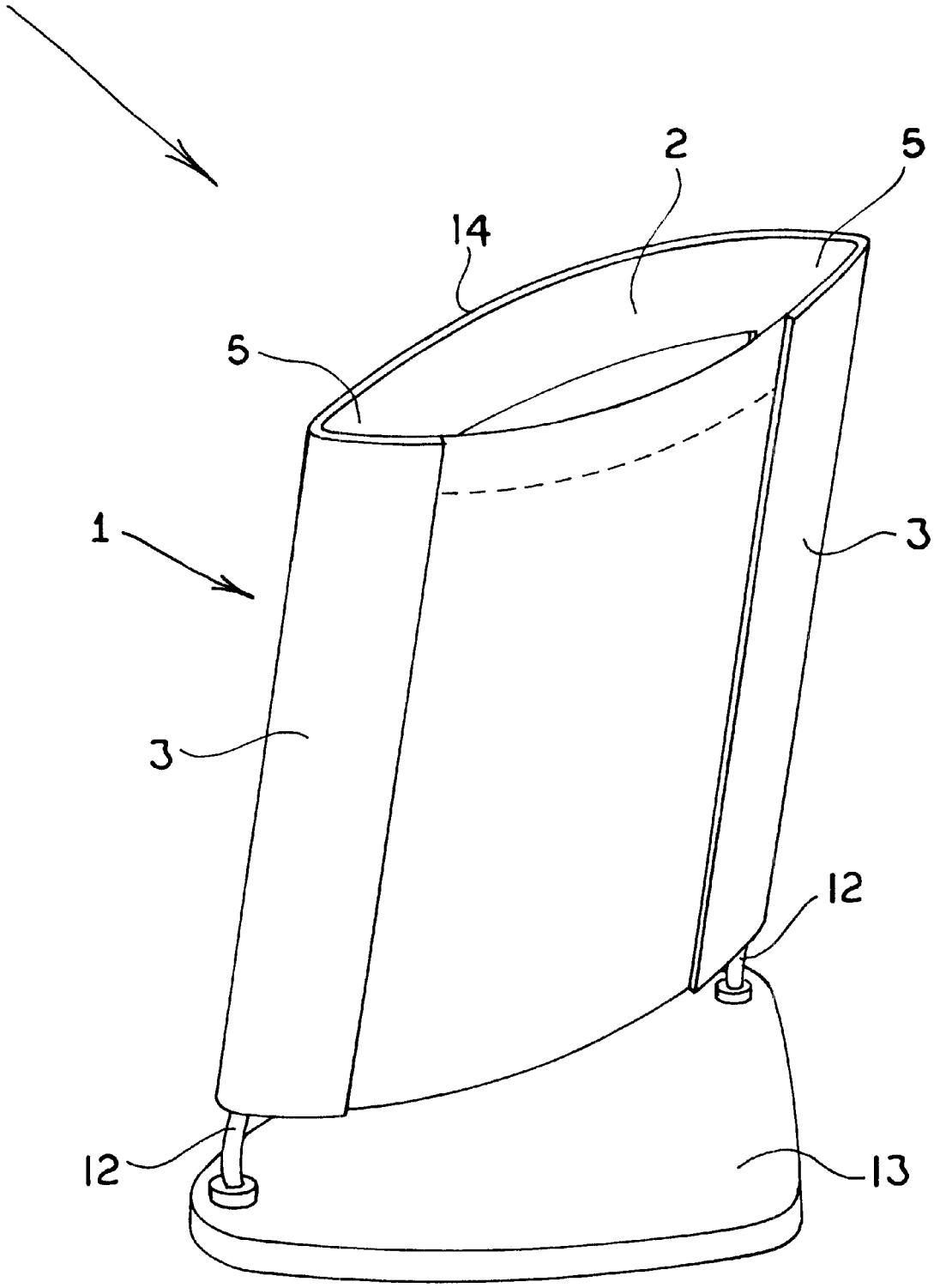
FIG. 1 is a rear perspective view of an apparatus in accordance with the present invention showing in the mount or display apparatus the convex back side of an assemblage of two flexible sheets which, in a preferred form of the present invention, sandwich a flexible photograph, the upper extent of which rises to at least the broken line shown, there being a viewing opening provided by the frame-like form of the front panel through which the concave presentation of the photograph can be viewed, and there being two inwardly directed flanges from the front panel to each define with the front panel an opposed channel.
Figure 2:
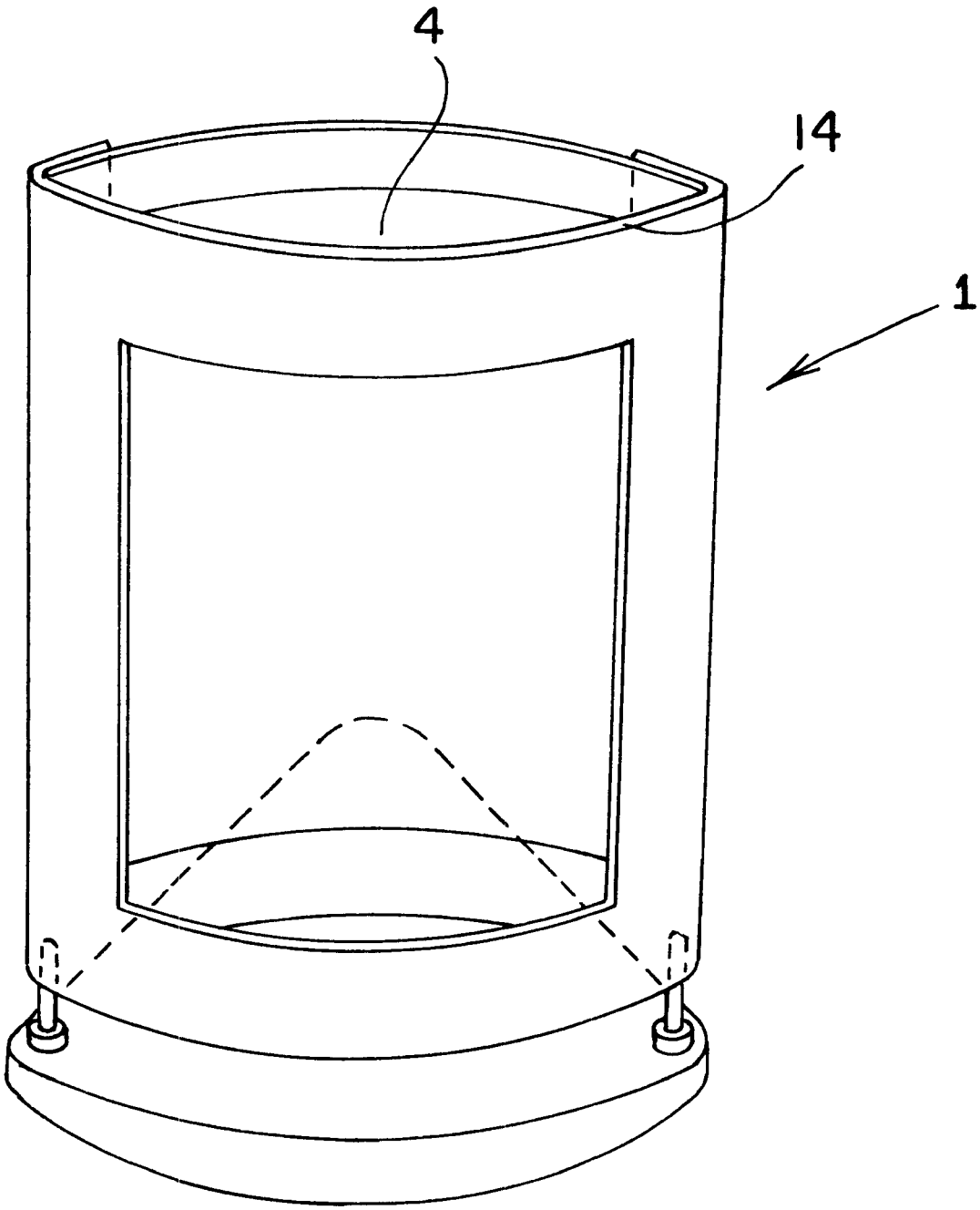
FIG. 2 is a front perspective view of the arrangement shown in FIG. 1 showing the concave presentation of a photograph (no image shown) that is sandwiched between a pair of flexible sheet members, at least the front sheet member being transparent to allow the viewing of the photograph.

The present invention in its preferred form recognizes the prospect of utilizing a degree of concavity of the two-dimensional material where the arc of concavity is not curved substantially more tightly than that of a circumference of a circle having a similar axis to that of the concavity where that concave presentation is tied to a frontal bordering of the two-dimensional material with a convex surface of substantially an opposite convexity to that of the concavity of the two-dimensional material. This enhancement provided by the juxtaposition of the convex framing or bordering of an image or picture (if that is the nature of the two-dimensional material) enhances the three-dimensional effect notwithstanding the use of less concavity than that disclosed in DE29703342.

Other two-dimensional materials may be presented so as to provide a three-dimensional effect, for example, pressed flowers, and thus, in its broadest aspect, the two-dimensional material need not be restricted to a picture or image such as that of a photograph.

Preferably, there is a parallel relationship between the axes of the concavity and convexity although in some forms the present invention minor deviations from that parallel relationship may be allowable. In the preferred forms of the present invention, however, all reference to convexity and concavity refer to curving about a single or parallel axis, that is, it does not encompass a dome-like convex surface or the opposite type concave surface.

In the preferred form of the present invention, a mount 1 is preferably molded from a suitable plastics material, for example, PVC, to define a picture frame-like front panel 2 and two rearward flanges 3 which provide a viewing opening 3' for a photograph 4 that may directly be supported at least in part by the opposed channels 5 or as shown in the drawings, by sandwiching resilient sheets 6 and 7, where that sheet of sheets 6 and 7 is to be over the image of the photograph 4 is transparent.

In the form depicted, the lower ends of each channel 5 are preferably provided with a molded shoulder 8 onto which the rebates 9 and 10 of the sheets 6 and 7, respectively, may be supported to ensure correct positioning in the mount.

The molded mount 1 preferably includes openings 11 into which pins 12 (e.g., steel, aluminum or plastic) upstanding from a molded base 13 (e.g., of PVC) can be inserted to support the preferred upright, yet rearwardly inclined, disposition of the mount 1 as shown in FIG. 1. Indeed, the base preferably includes means directly engageable with the molded mount where the whole item is molded in two parts. It can, of course, be molded as a single part and still define the same type mount 1.

Figure 10:
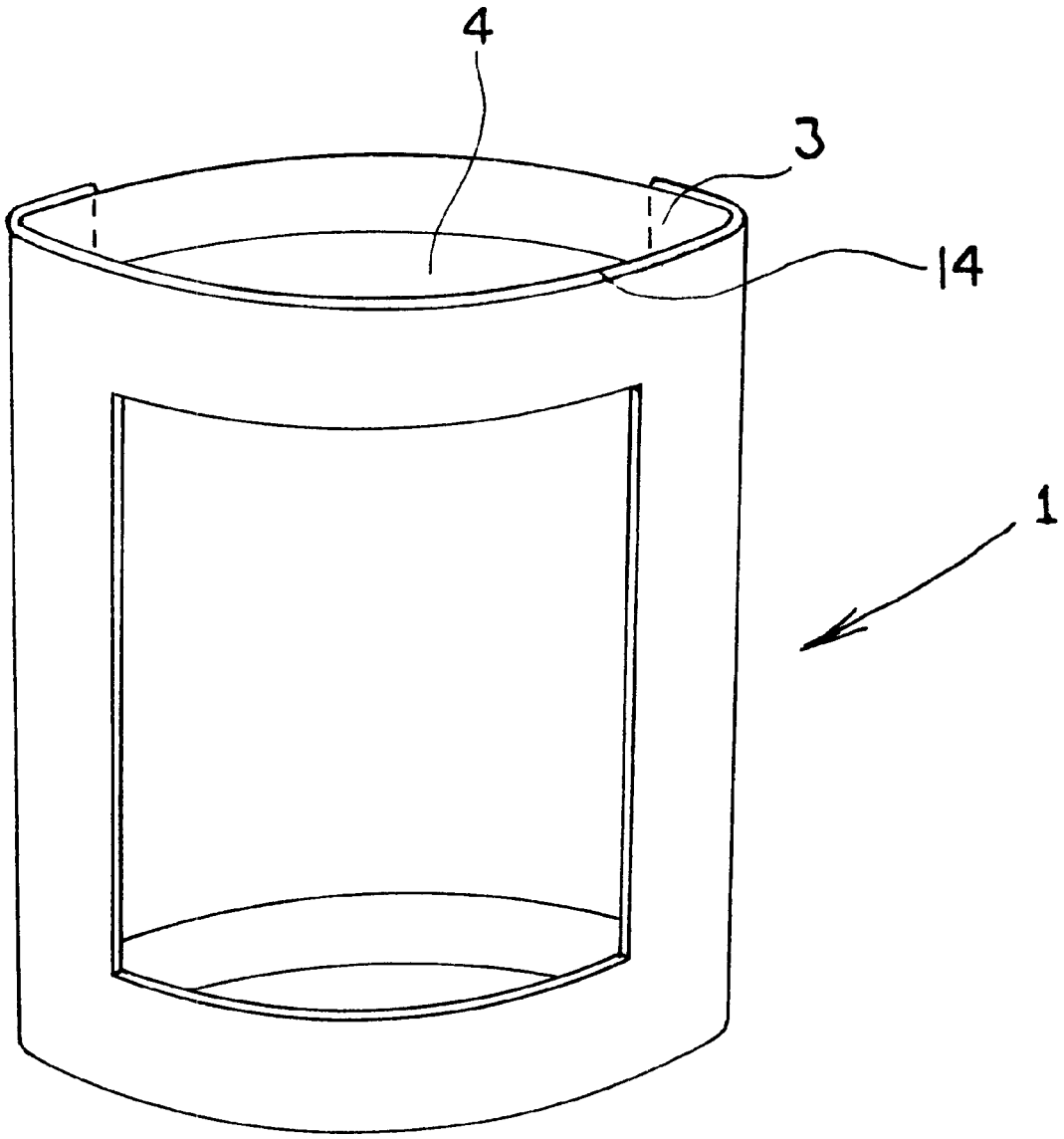
FIG. 10 is a similar view to that of FIG. 2, but showing an alternative embodiment in which the base is not used.

Alternatively, as shown in FIG. 10, the display apparatus is able to stand without a base, and may be formed as to incline a little for ease of viewing.

Figure 3:
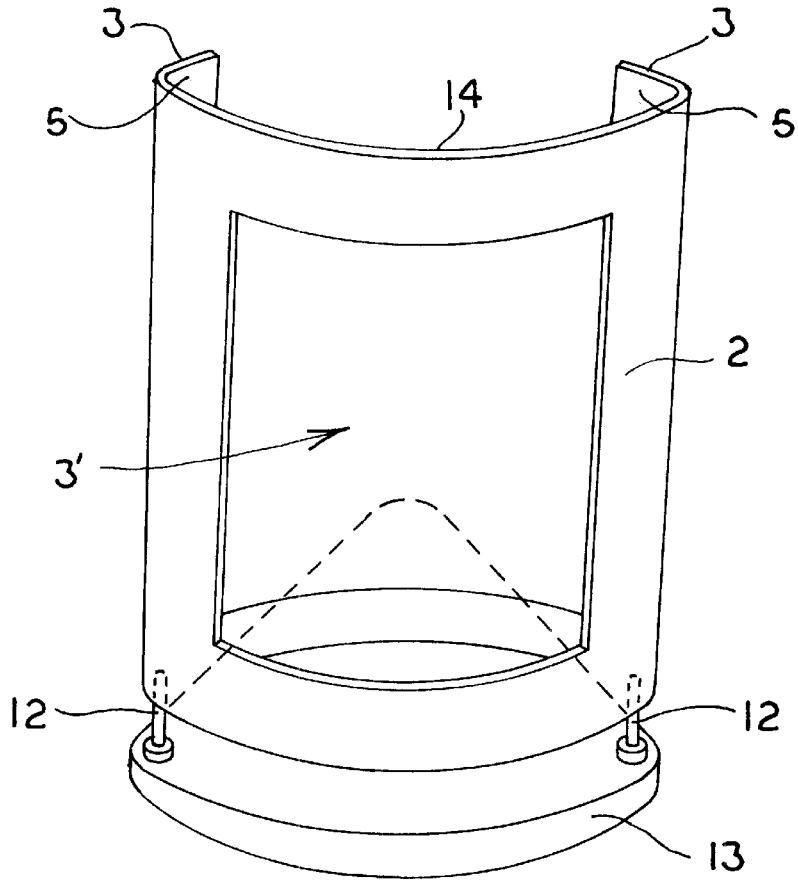
FIG. 3 is the apparatus of FIG. 2 with an assemblage of the photograph between two resilient sheets having been removed.
Figure 4:
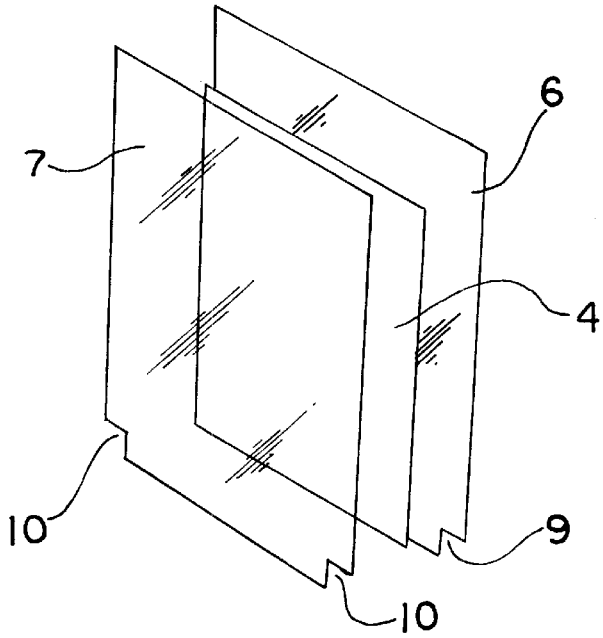
FIG. 4 is the assemblage of FIG. 2 that has been removed from the mount of FIG. 3.

In use, a mount of the kind shown in FIG. 3 can provide for an edgewise compression of the FIG. 4 assemblage in the retaining channels 5 so that a stable concave display condition (as shown in FIG. 1 when considered from the viewing direction shown by the arrow in FIG. 1) achieved behind a convex framing thereof which adds to the preferred illusion of a three-dimensional image.

The same relationship between the front panel 2 and its preferred framing of the image provided by the photograph 4 viewable through the front panel viewing opening 3 can be achieved where the photograph itself is coupled with only one resilient member that can hold the photograph in position and to its arcuate form. With any such arrangement preferably there is sufficient edgewise compression on one or other of the plies of the assemblage to ensure stability of presentation of the image in the concave three-dimensional effect providing form.

In still other embodiments, a bare photograph when printed on a substrate having sufficient resilience can, even without being coupled with one or other of sheets 6 and 7, be mounted in the conditions shown in the accompanying drawings reliant upon its own inherent resilience.

Figure 8:
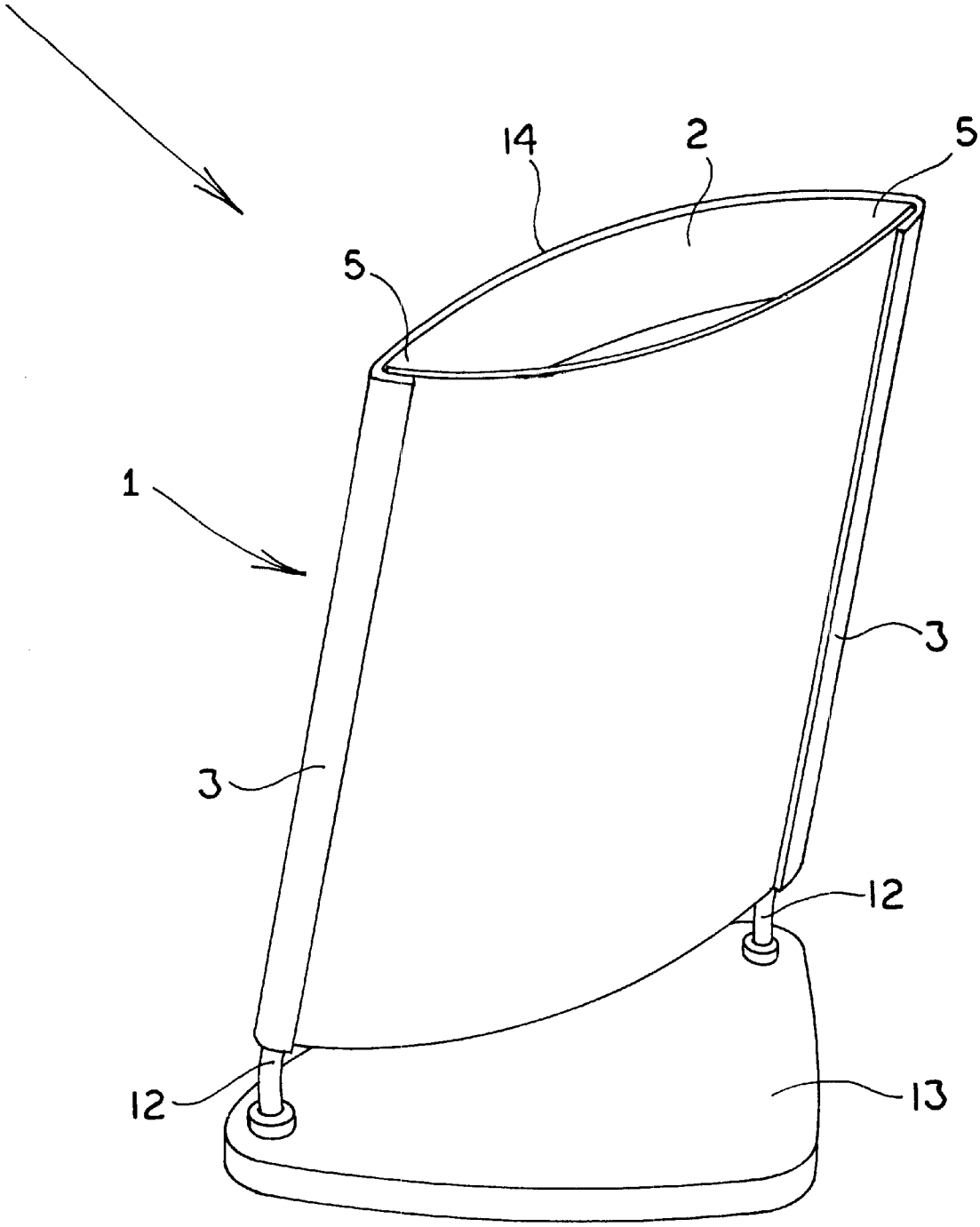
FIG. 8, is a similar view to that of FIG. 1, but showing an alternative embodiment where the inwardly directed flanges are much smaller in size than those shown in FIG. 1.
Figure 9:
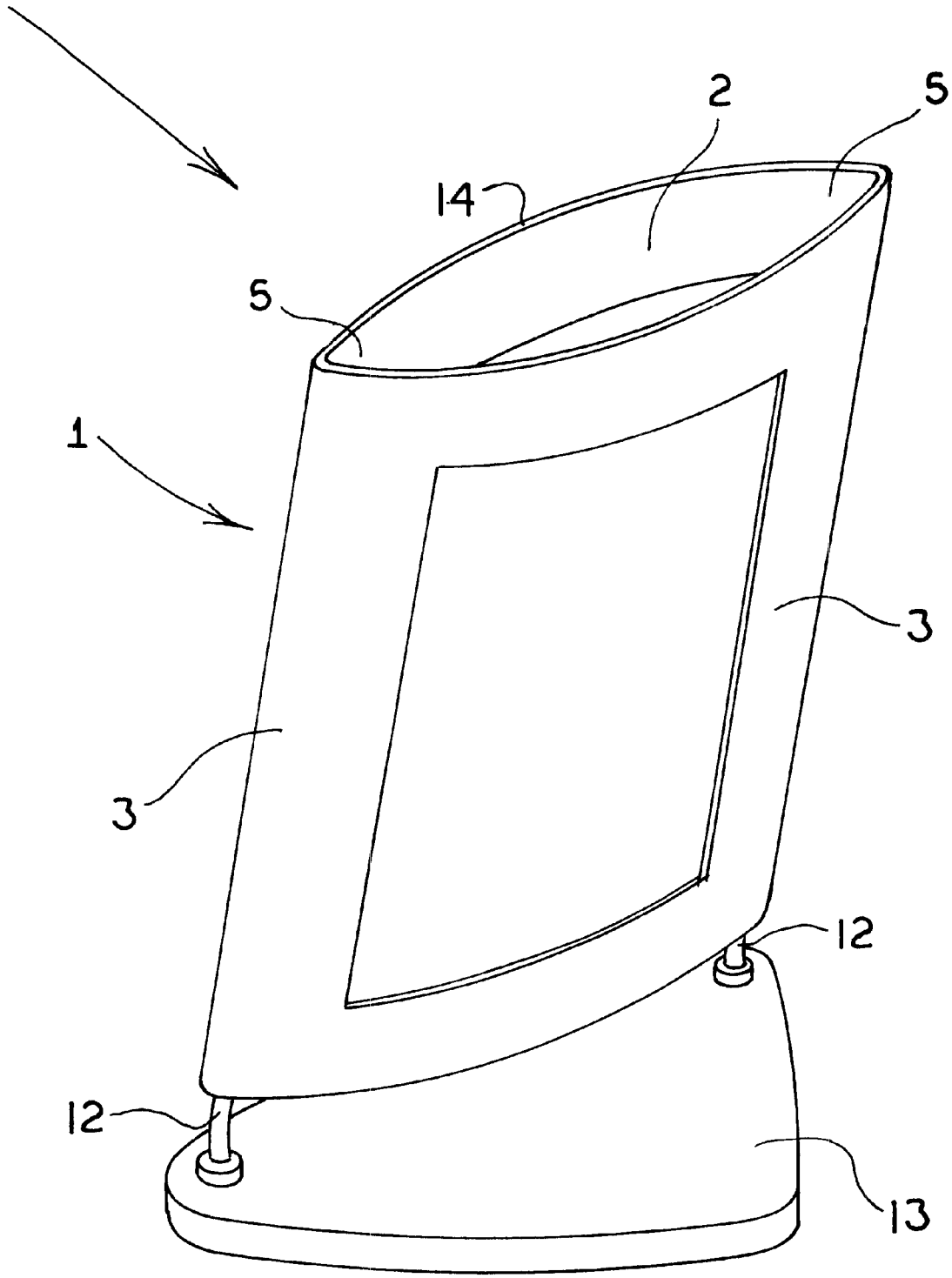
FIG. 9 is a similar view to that of FIG. 1, but showing an alternative embodiment where the back of the display device also takes a frame-like form.

FIG. 8 shows an alternative embodiment where the inwardly directed flanges are much smaller in size than those shown in FIG. 1, and where the edgewise compression alone serves to retain the sheets in the display apparatus. Another alternative embodiment is shown in FIG. 9 where the back of the display device also takes a frame-like form.

Figure 6:
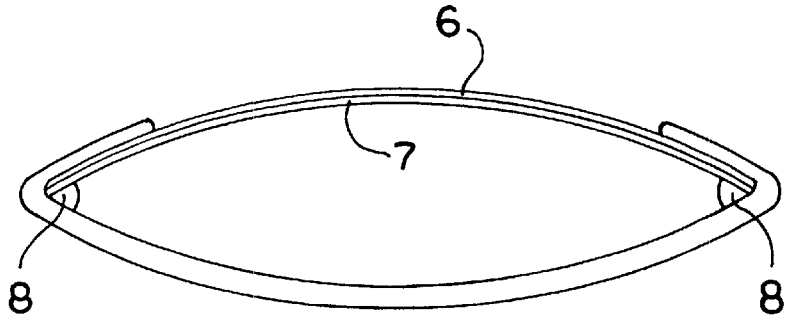
FIG. 6 is the top view of the apparatus as it is depicted in FIG. 5.
Figure 5:
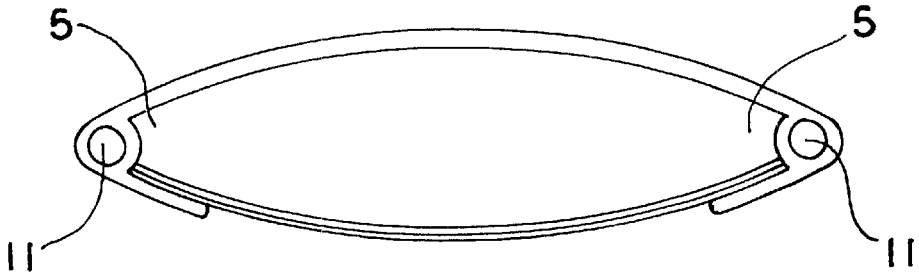
FIG. 5 is a view from below the molded mount or display apparatus having the opposed channels showing two openings into which pedestals, rods, or the like can be positioned in order to support the mount in an upright condition from (for example, a stand as depicted in FIGS. 1, 2 and 3) preferably with some slight incline rearwardly (when considered from the viewing direction) from a vertical condition, FIG. 5 showing the assemblage of resilient sheets in an arcuate condition that they will assume (supported in part by the interior surfaces of the rear flanges) under an edgewise compression that preferably presents the image in a concave manner to the viewing direction.
Figure 7:
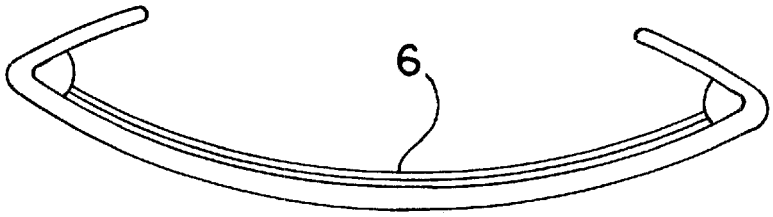
FIG. 7 is a similar view to that of FIG. 6 but showing the assemblage having been pressed from its stable concave presentation of FIG. 6 (to the viewing direction) to a stable convex form of presentation (to the viewing direction), the viewing direction in each of FIGS. 6 and 7 being from the bottom of the figure.

While there has been reference to a stable concave form owing to the edgewise compression, such stability is not such as preferably will prevent the pressing of the assemblage from the condition shown in FIGS. 1 and 6 to the condition of FIG. 7 which for some people may be preferred, or which might be preferred during storage, and the like. For example, where a bundle of the-mounts are to be partially nested, the form shown in FIG. 7 (irrespective of whether or not there is an actual photograph at that time in the assemblage) might be preferred.

Rearwardly-directed retention flanges or lips 14 at the top and, if desired, at the bottom of the means defining a convex surface, can be provided whose function is to provide a stable location of the resilient sheet when in the convex condition, and the ends of which assist somewhat in retention of the resilient sheet in the concave condition as well.

A person skilled in the art will appreciate that any appropriate plastics material for the mount and the carrier resilient sheets 6 and 7 can be utilized.

What is claimed is:

1. Display apparatus for conferring a three-dimensional viewing effect to a displayed two-dimensional material, the apparatus comprising convex surface defining means having a viewing opening therethrough, and material presenting means to present said two-dimensional material for viewing through said opening from the convex surface side of said convex surface defining means, wherein said material presenting means can present said two-dimensional material for viewing when said two-dimensional material is curved oppositely to said convex surface so as to be concavely presented for viewing, wherein the convex surface defining means and at least part of the material presenting means are in a fixed relationship, and wherein resilient sandwiching means are provided for said two-dimensional material, said resilient sandwiching means are held under edgewise compression in a stable condition by said at least part of the material presenting means so as to provide the concave presentation for viewing of the two-dimensional material and wherein said resilient sandwiching means define at least one rebate for locating the two-dimensional material for viewing.

2. Display apparatus for conferring a three-dimensional viewing effect to a displayed two-dimensional material, the apparatus comprising convex surface defining means having a viewing opening therethrough, and material presenting means to present said two-dimensional material for viewing through said opening from the convex surface side of said convex surface defining means, wherein said material presenting means can present said two-dimensional material for viewing when said two-dimensional material is curved oppositely to said convex surface so as to be concavely presented for viewing, and wherein a molded member defines both the convex surface of said convex surface defining means and said material presenting means behind said convex surface, said material presenting means including two opposed channels into which said two-dimensional material is to be held under edgewise compression.

3. Display apparatus as claimed in claim 2 wherein said two-dimensional material without removal from said apparatus can be pushed to a stable curve no longer opposite to said convex surface.

4. A display apparatus for conferring a three-dimensional viewing effect to a displayed two-dimensional material, the apparatus comprising a member defining a convex surface having a viewing opening therethrough, said member defining a pair of opposed channels adapted to hold the two-dimensional material in edgewise compression, a pair of flanges curved oppositely to said convex surface such that the two-dimensional material is presented concavely for viewing through said opening, and a pair of shoulders formed adjacent said channels and adapted to locate said two-dimensional material relative to said viewing window.

5. The display apparatus of claim 4 further comprising at least one resilient sheet layered upon the two-dimensional material, said resilient sheet defining at least one rebate adapted to cooperate with said shoulder to locate said two-dimensional material for viewing.

* * * * *